US007165483B2

(12) United States Patent
Bailer et al.

(10) Patent No.: US 7,165,483 B2
(45) Date of Patent: Jan. 23, 2007

(54) APPARATUS AND METHOD FOR CLAMPING AND POSITIONING WORKPIECES OF DIFFERENT LENGTH BETWEEN TWO CENTERS

(75) Inventors: Peter Bailer, Schemmerhofen-Altheim (DE); Siegfried Veil, Ochsenhausen (DE)

(73) Assignee: Vollmer Werke Maschinenfabrik GmbH, Biberach/Riss (DE)

( * ) Notice: Subject to any disclaimer, the term of this patent is extended or adjusted under 35 U.S.C. 154(b) by 101 days.

(21) Appl. No.: 11/081,414

(22) Filed: Mar. 16, 2005

(65) Prior Publication Data

US 2005/0204880 A1 Sep. 22, 2005

(30) Foreign Application Priority Data

Mar. 16, 2004 (DE) ..... 10 2004 012 823

(51) Int. Cl.
*B23B 3/00* (2006.01)

(52) U.S. Cl. ..... 82/1.11; 82/142; 82/148; 82/162

(58) Field of Classification Search ..... 82/1.11, 82/142, 148, 162
See application file for complete search history.

(56) References Cited

U.S. PATENT DOCUMENTS 3,046,822 A * 7/1962 Von Zelewsky ..... 82/11.5
4,951,422 A * 8/1990 Ibe et al. ..... 451/5
5,421,229 A * 6/1995 Grossmann et al. ..... 82/124
5,758,554 A * 6/1998 Miyano ..... 82/1.11
6,058,988 A * 5/2000 Hardesty ..... 144/135.2
6,173,630 B1 * 1/2001 Wu ..... 82/129
6,827,631 B2 * 12/2004 Tomotaki et al. ..... 451/11

FOREIGN PATENT DOCUMENTS

CH 692450 6/2002
DE 274585 12/1989

* cited by examiner

*Primary Examiner*—Willmon Fridie, Jr.
(74) *Attorney, Agent, or Firm*—Woodard, Emhardt, Moriarty, McNett & Henry LLP

(57) ABSTRACT

In an apparatus (10) for clamping and positioning workpieces (36) of different length between two centers (26,28), comprising a base (14) with at least one linear guide (18), a first carriage (20) displaceable in a linearly guided manner on the linear guide (18) and having a clamping center (26), a second carriage (22) displaceable in a linearly guided manner on the linear guide (18) and having a tail center (28), and a drive means coupled to the first or/and the second carriage (20,22), it is provided that the first carriage (20) and the second carriage (22) are displaceable on the linear guide (18) relative to one another and relative to the base (14) in such a way that workpieces (36) of different length can be received between the clamping center (26) and the tail center (28), it furthermore being the case that the first or/and the second carriage (20,22) have a prestressing means (78) and it being the case that the clamping center (26) or/and the tail center are displaceable, on contact (28) with the workpiece (36) to be clamped, under spring prestress towards the workpiece (36) to be clamped.

20 Claims, 8 Drawing Sheets

APPARATUS AND METHOD FOR CLAMPING AND POSITIONING WORKPIECES OF DIFFERENT LENGTH BETWEEN TWO CENTERS

Foreign priority benefits under Title 35 United States Code §119 are claimed from German Patent Application No. 10 2004 012 823.5, filed on Mar. 16, 2004.

The present invention relates to an apparatus and a method for clamping and positioning workpieces of different length.

Such an apparatus is known, for example, from Swiss Patent CH 692 450. The apparatus described in this patent is a grinding machine in which elongated workpieces are received at one end by a workpiece-holding device and another end of these workpieces is clamped by a tail centre relative to the workpiece-holding device. The workpiece-holding device and the tail centre are each attached to numerically controlled carriages. For clamping, the workpiece is first received by the workpiece-holding device and then the workpiece-holding device together with the workpiece and the tail centre are moved relatively towards one another, so that the tail centre penetrates into a corresponding receptacle, in particular into a centre, at the end face of the workpiece to be machined. Generally, this receptacle is conically shaped and receives the tail centre for clamping purposes. The problem here is that this receptacle provided at the end face of the workpiece to be clamped can have different dimensions, so that when clamping different workpieces of the same length, different positions for the carriages can result owing to differently dimensioned receptacles (centres). Such systems also have the fundamental problem that the two carriages with workpiece-holding device and tail centre must be suitably positioned relative to one another according to the actual workpiece length in order to clamp the workpiece securely with sufficient prestress but without damaging it.

It is therefore the object of the present invention to provide an apparatus and a method for clamping and positioning workpieces so that secure clamping can be achieved while reliably avoiding damage to the workpiece.

This object is achieved by an apparatus for clamping and positioning workpieces of different length between two centres, comprising a base with at least one linear guide, a first carriage displaceable in a linearly guided manner on the linear guide and having a clamping centre, a second carriage displaceable in a linearly guided manner on the linear guide and having a tail centre, and a drive means coupled to the first or/and the second carriage, it being the case that the first carriage and the second carriage are displaceable on the linear guide relative to one another and relative to the base in such a way that workpieces of different length can be received between the clamping centre and the tail centre, it furthermore being the case that the first or/and the second carriage have a prestressing means and it being the case that the clamping centre or/and the tail centre are displaceable, on contact with the workpiece to be clamped, under spring prestress towards the workpiece to be clamped.

With the apparatus according to the invention, it is possible firstly to bring the workpiece to be clamped into contact with the clamping centre or/and the tail centre and then to displace the first or/and the second carriage in such a way that sufficient prestress can be produced via the centre and the tail centre. It can thereby on the one hand be ensured that each workpiece irrespective of its length is reliably clamped with sufficiently high clamping force between clamping centre and tail centre. Moreover, damage to the workpiece during clamping is precluded since, in the event of unintentional contact between workpiece and clamping centre or tail centre, merely the prestress is increased and an abrupt rise in the force acting on the workpiece can thereby be prevented.

In order to facilitate the clamping, a development of the invention provides that the workpiece to be clamped can be positioned, by a positioning carriage holding it, between the clamping centre and the tail centre. In this context, it can furthermore be provided that the positioning carriage is linearly guided on a linear guide. An advantageous embodiment of the invention provides that the positioning carriage has a further prestressing means and that the positioning carriage, on contact of the workpiece with the clamping centre or the tail centre, is displaceable under spring prestress relative to the clamping centre or tail centre engaging on the workpiece. Through the displacement of the positioning carriage under spring prestress, it is possible—as will be explained in detail below—to achieve particular advantages with regard to exact positioning, on the apparatus, of the workpiece to be clamped.

In principle, it is possible to realise the drive means using any linear drives. A cost-effective, low-maintenance drive which can be exactly positioned is achieved particularly by using a threaded spindle-nut arrangement.

In a simple embodiment of the invention, it is provided that the first carriage is assigned a separate drive means, the first carriage being coupled to the nut displaceable on the threaded spindle. Additionally or alternatively to this, it can also be provided that the second carriage is assigned a separate drive means, the second carriage being coupled to the nut displaceable on the threaded spindle. As a further addition, it is also possible that the positioning carriage is assigned a separate drive means, the positioning carriage being coupled to the nut displaceable on the threaded spindle. According to the invention, however, individual or all carriages can also be displaced manually relative to the base, for example via a hand lever.

In an exemplary embodiment of the invention, between the nut and the respective carriage there is provided a coupling arrangement which allows a relative movement between nut and respective carriage with a spring prestress building up in the process. This embodiment variant of the invention has the advantage that the clamping centre or tail centre and the holding arrangement on the positioning carriage are each firmly connected to the carriage assigned to them and are guided on the linear guide. As a result, the centres and the positioning device are positioned exactly relative to the base. The prestress is achieved via the coupling arrangement and a relative movement between the nut and the respective carriage inside the coupling arrangement. With regard to the positioning of the workpiece, this affords significant advantages over known systems in which a coupling device is arranged between the centre and the carriage guided on the linear guide. In such known systems, inaccuracies in the positioning of the centre can occur because of the spring-prestressed deflection and the play necessary for this.

With regard to the coupling arrangement, it can be provided according to the invention that the coupling arrangement comprises a roller-ramp pairing with a roller arranged between two mutually opposite ramp surfaces and rolling on these surfaces, the roller being arranged on the one component of nut and carriage assigned to the latter, and the ramp surfaces being arranged on the other component of nut and carriage assigned to the latter. In this case, in a development of the invention it can be provided that the roller or the ramp surfaces are displaceable under spring prestress relative to the nut or the respective carriage. A structurally simple and functionally reliable realisation of this solution can be achieved, for example, by the fact that the roller is arranged on the nut and that a spring-prestressed slide formed with the ramp surfaces is displaceably guided on the respective carriage, the slide being displaced, upon a relative displacement of nut and respective carriage, against the spring prestress substantially in the direction orthogonal to the direction of the relative displacement.

In order to enable detection of a given spring prestress or a given relative deflection between carriage and nut, a development of the invention provides that the coupling device is assigned at least one limit switch which is activated when a predetermined distance is reached upon a relative displacement between nut and respective carriage. Advantageously, in one embodiment, two limit switches are provided, which enable detection of a relative displacement between nut and respective carriage in both displacement directions.

Furthermore, for accurate positioning of first and second positioning carriages, it is advantageous if at least one of the carriages, preferably each carriage, is assigned a position sensor for determining the current position of the carriage relative to the base.

To increase the operational safety of the apparatus according to the invention, a development of the invention provides that each carriage is assigned at least one safety limit switch, the drive means stopping when the limit position predefined by the limit switch is reached. It can thereby be detected when one of the carriages approaches a limit position which it is not possible to go beyond owing to the design of the apparatus according to the invention and at which further displacement must not occur.

The invention furthermore relates to a method for clamping and positioning workpieces of different length between two centres using an apparatus of the above-described type, comprising the steps of:

A) positioning the workpiece to be clamped, in a region between the centres,

B) bringing the workpiece into contact with the clamping centre at a workpiece clamping point facing the clamping centre, C) displacing the second carriage to bring the workpiece into contact with the tail centre at an opposite workpiece clamping point facing the tail centre, D) driving the second carriage in the direction of the first carriage after bringing the workpiece into contact with the tail centre at the opposite clamping point, E) detecting a prestress which builds up in step D) or a quantity characterising this prestress, and F) deactivating the drive means assigned to the second carriage when a predetermined clamping prestress is reached.

With regard to feature E), it should be noted that the quantity characterising the prestress which is detected is, for example, the deflection of the slide and that by taking account of the spring hardness the prestress can be deduced.

To facilitate carrying out the method according to the invention, a development of the invention provides that step A) is carried out using a positioning carriage which firmly holds the workpiece during the clamping. Positioning and clamping of the workpiece with full numerical control and without manual intervention is thereby possible.

An advantageous development of the method according to the invention provides that at step B) the first carriage is or can be rigidly coupled to the nut of its drive means, that after bringing the workpiece into contact the first carriage is further displaced, by a predetermined distance, towards the positioning carriage, during which the positioning carriage is deflected relative to the nut of its drive means under spring prestress, then the first carriage is stopped when a predetermined limit prestress or a predetermined limit deflection of the positioning carriage is reached, and that the first carriage is moved back to reduce the prestress and the deflection of the positioning carriage. This development of the method according to the invention enables one side of the workpiece to be positioned in a predetermined position, in particular when this side has a standard centre for receiving the clamping centre. For, according to this embodiment variant of the method according to the invention, the clamping centre is situated at a predetermined position and does not yield resiliently. The prestressing force required for clamping is consequently achieved rather by the second carriage and its movement.

The accuracy of the method according to the invention can be increased by the fact that the first carriage is moved back so far until the prestress and the deflection of the positioning carriage is almost zero or precisely zero.

Furthermore, according to the invention it can be provided that in step E) firstly the reaching of a predetermined limit prestress or a predetermined limit deflection is detected, and that when the predetermined limit prestress or limit deflection is reached, the nut of the drive means assigned to the second carriage is displaced by a predetermined clamping distance. A defined prestress in workpieces of any length can thereby be achieved. The apparatus according to the invention thus adapts, so to speak, automatically to the workpiece length.

The invention is explained below by way of example with reference to the accompanying figures, in which.

Figure 1:
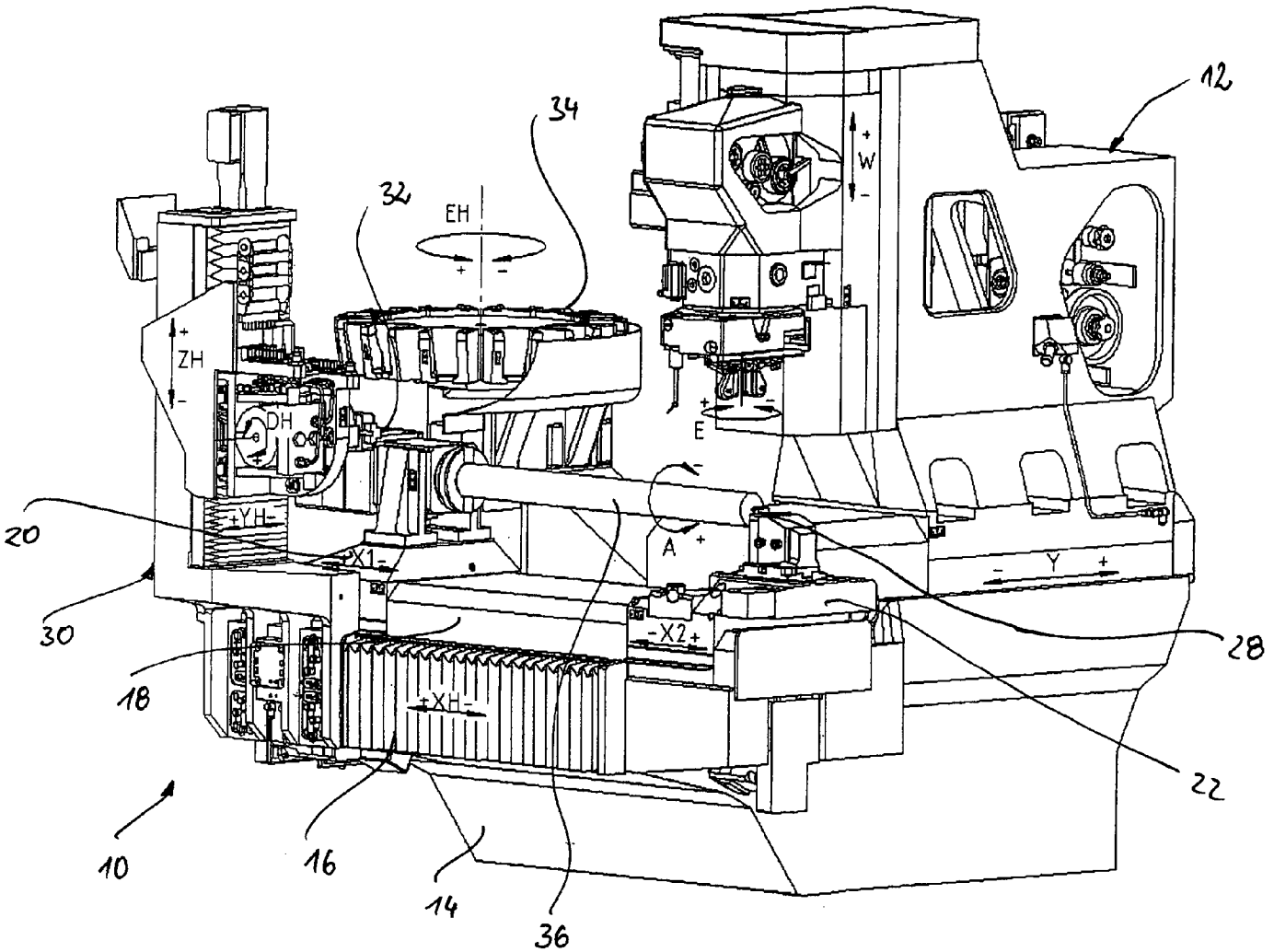
FIG. 1 shows a perspective general illustration of the apparatus according to the invention with a machining head.

In FIG. 1 an apparatus according to the invention is shown in a spatial illustration and denoted generally by 10. This apparatus is coupled to a machining unit 12, which will not be described in more detail below. As can be seen from FIGS. 2 and 3, the apparatus 10 according to the invention comprises a base 14 with linear guides 16 and 18. A first carriage 20 is linearly guided on the linear guide 18 and displaceable via a separate drive means in accordance with the double arrow X1 from FIG. 1. A second carriage 22 is likewise linearly guided on the linear guide 18 and displaceable via a separate drive means in accordance with the double arrow X2 from FIG. 1. The first carriage 20 has a receiving device 24, into which a clamping centre 26 is inserted. The clamping centre 26 is firmly coupled to the receiving device 24. The receiving device 24 is, in turn, firmly connected to the first carriage 20. The second carriage 22 also has a centre, namely the tail centre at 28.

On the base 14 a positioning carriage 30 is linearly displaceable on the linear guides 16 via a drive means. As can be seen from FIGS. 1 and 4, the positioning carriage 30 has a gripper 32 which can remove individual workpieces to be machined, such as milling cutters for example, from a magazine 34 (FIG. 1) and position them between the clamping centre 26 and the tail centre 28, as shown in FIGS. 1 to 4 with the example of a workpiece 36 to be machined. For this purpose, the gripper 32 can be displaced and rotated in various directions via the positioning carriage 30. The directions are indicated in FIG. 1 by the double arrows DH, XH, YH, ZH.

Figure 6:
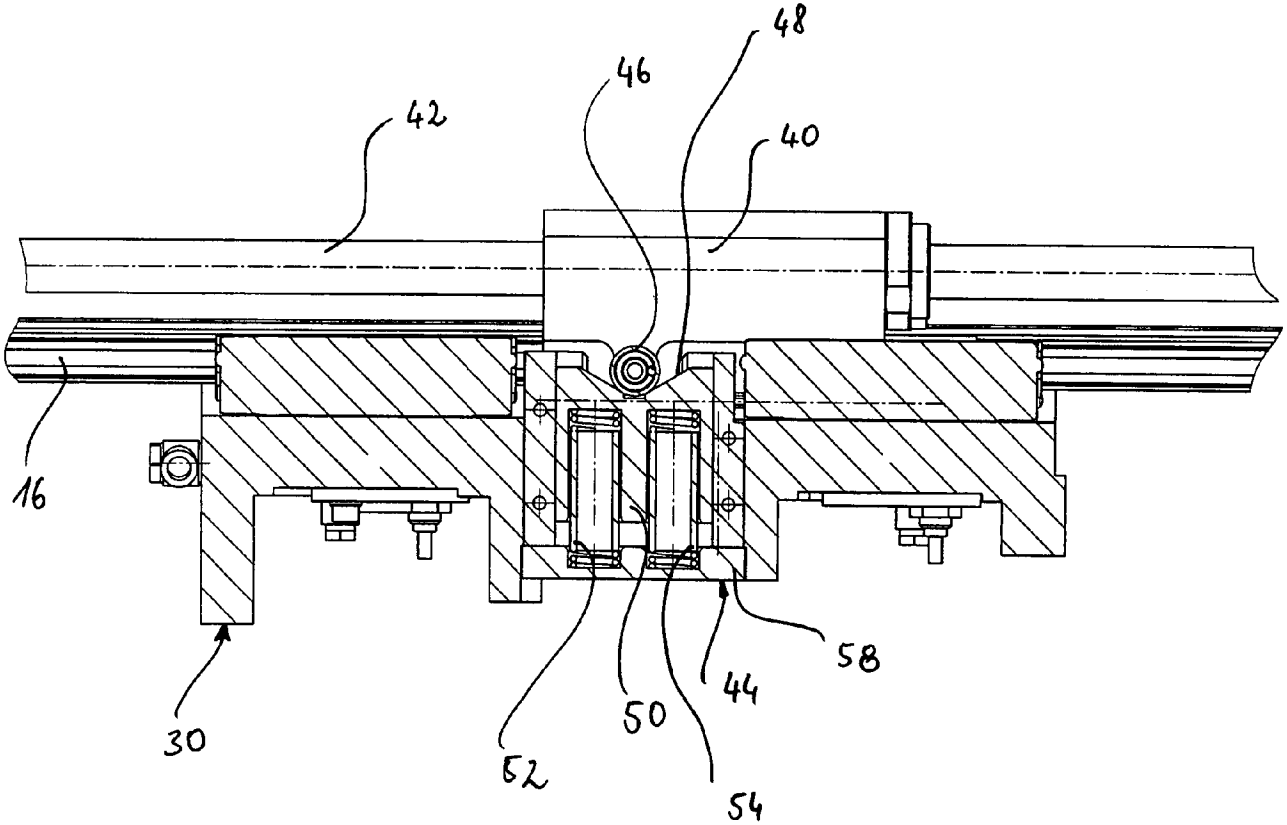
FIG. 6 shows a sectional illustration along section line VI—VI from FIG. 5.

The apparatus 10 according to the invention will be discussed below in particular with regard to the clamping of the workpiece 36 between the clamping centre 26 and the tail centre 28. As FIG. 6 shows, the positioning carriage 30 is linearly guided on the linear guide 16. The positioning carriage 30 is coupled to a nut 40 which cooperates with a threaded spindle 42. The threaded spindle 42 is rotationally drivable via a drive (not shown), so that the nut 40 is displaceable on the threaded spindle 42 in the manner of a spindle-nut drive. The coupling between nut 40 and positioning carriage 30 is realised by a coupling device 44. The coupling device 44 has a roller 46 rotatably mounted on the nut 40, and a ramp arrangement 48 formed on a slide 50 displaceable in a guided manner into the positioning carriage 30. The slide 50 is prestressed into its position shown in FIG. 6 via prestressing springs 52 and 54. The prestressing springs 52 and 54 are supported on a support plate 58. The ramp arrangement 48 has two surfaces inclined in a V-shape relative to one another which receive the roller 46.

Upon relative displacement of nut 40 and positioning carriage 30, the roller 46 rolls on one of the inclined surfaces of the ramp arrangement 48 and deflects the slide 50 against the prestress of the prestressing springs 52 and 54. The displacement of the slide 50 here can be detected by means of a limit switch (not shown).

Figure 7:
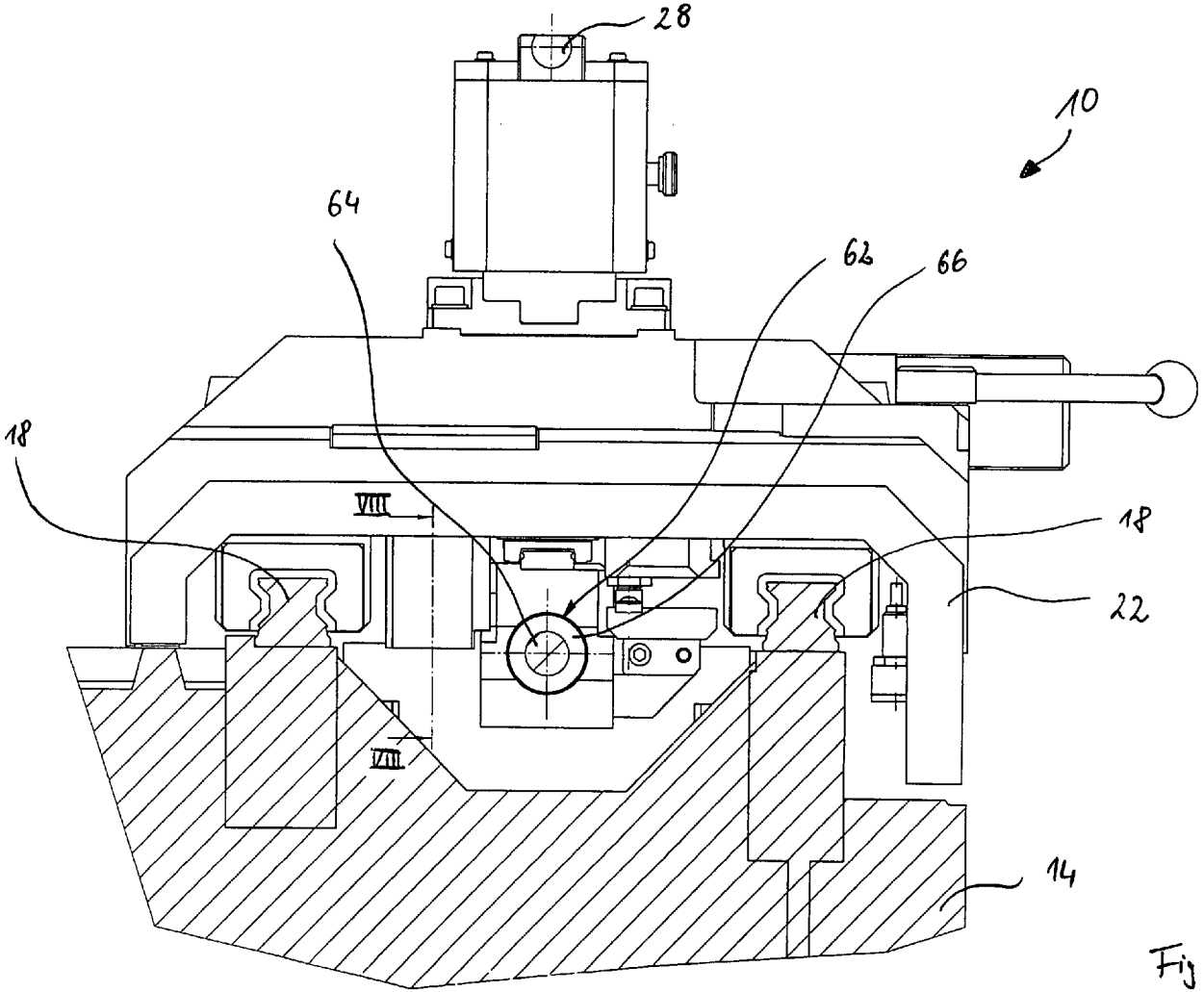
FIG. 7 shows a sectional illustration corresponding to section line VII—VII from FIG. 2.
Figure 8:
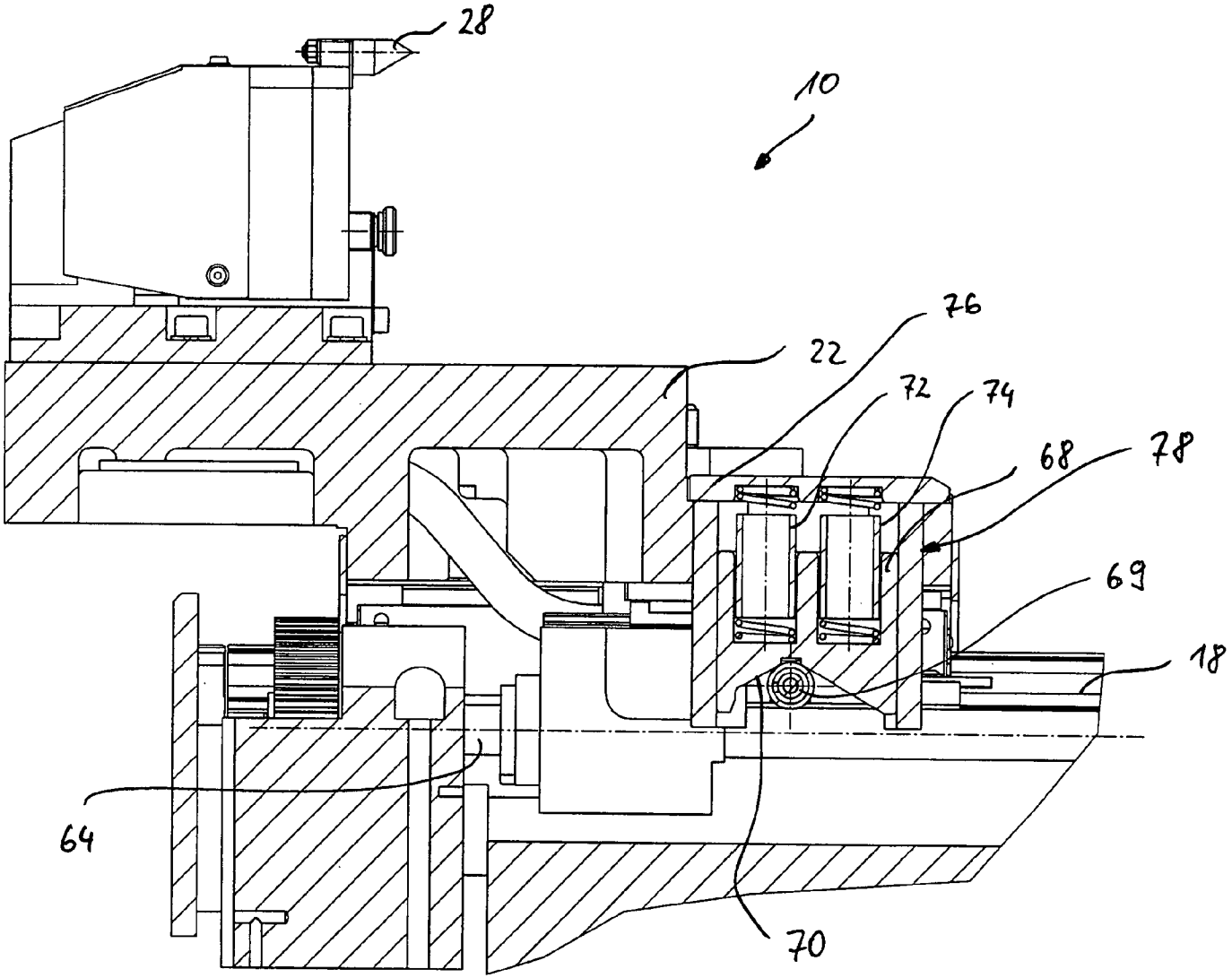
FIG. 8 shows a sectional illustration corresponding to section line VIII—VIII from FIG. 7.

The second carriage 22 is, as shown in FIGS. 7 and 8, also linearly guided on the base 14 via the linear guides 18 and displaceable along the linear guides 18 via a spindle-nut arrangement 62 with the spindle 64 and the nut 66. The nut 66 is also coupled to a roller 69 rotatably mounted thereon. The second carriage 22 has a slide 68 guided therein, on which a ramp arrangement 70 with two surfaces inclined in a V-shape relative to another is formed. The slide 68 is prestressed into the position shown in FIG. 8 via prestressing springs 72 and 74, the prestressing springs 72 and 74 being supported on the support plate 76. The coupling arrangement 78 for coupling nut 66 and second carriage 22 acts in the same way as described above with regard to the positioning carriage 30. Again, the second carriage 22 can be displaced relative to the nut 66 driving it, during which a prestress builds up owing to the prestressing springs 72 and 74, depending on the relative displacement. The displacement of the slide 68 here can be detected by means of a limit switch (not shown).

Figure 2:
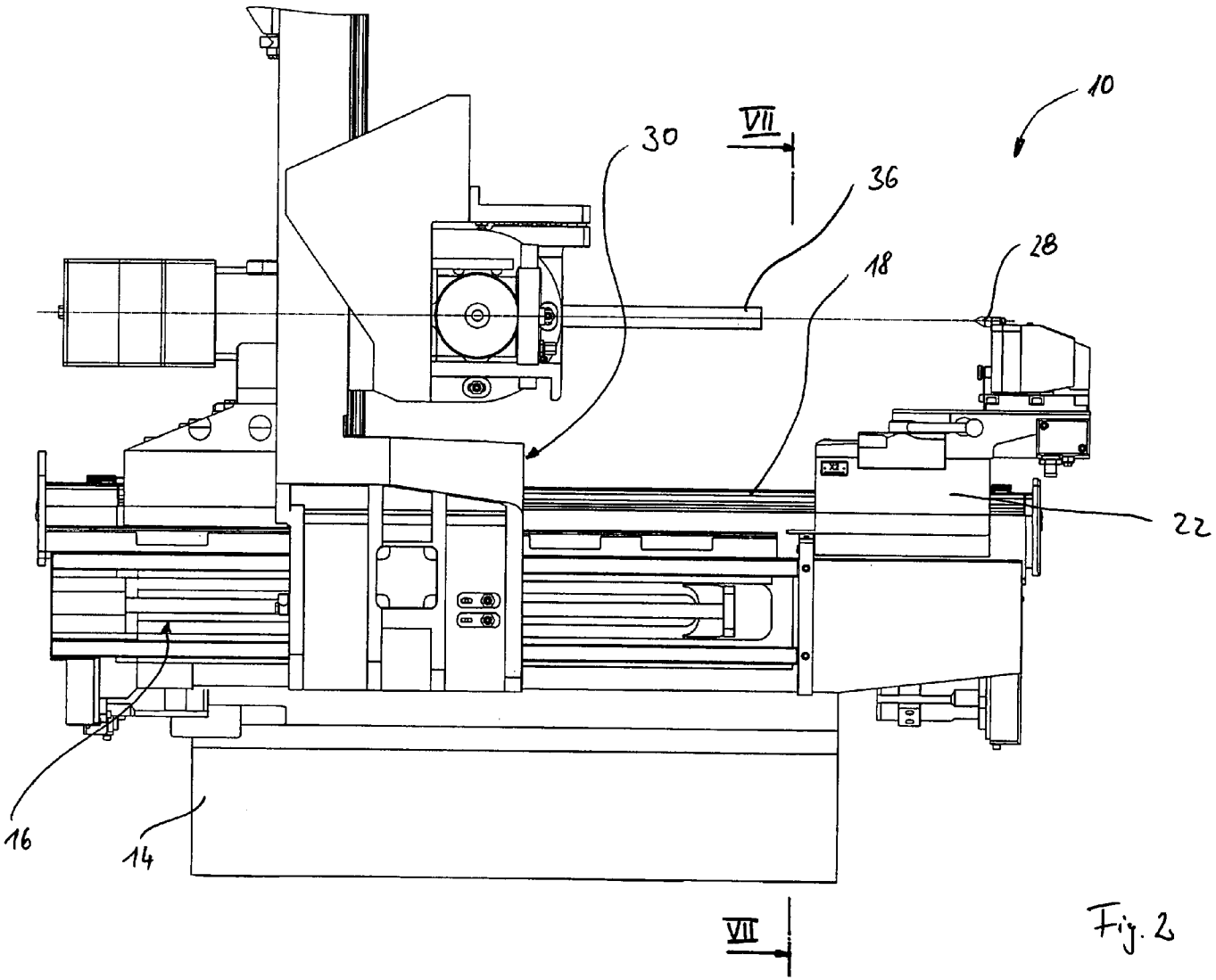
FIG. 2 shows a front view of the apparatus from FIG. 1, but without the machining head.
Figure 3:
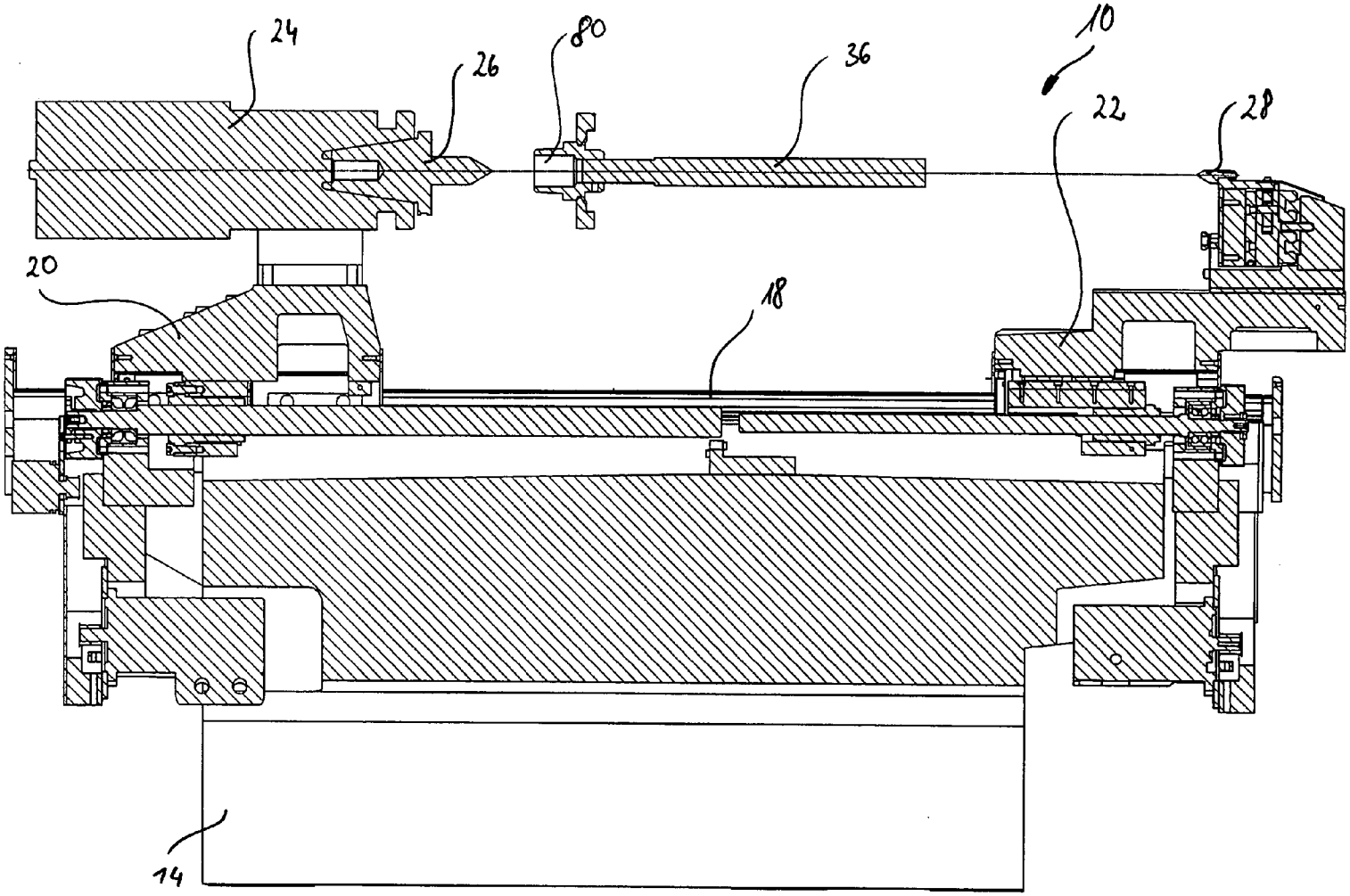
FIG. 3 shows a view corresponding to FIG. 1, but in a sectional illustration.
Figure 4:
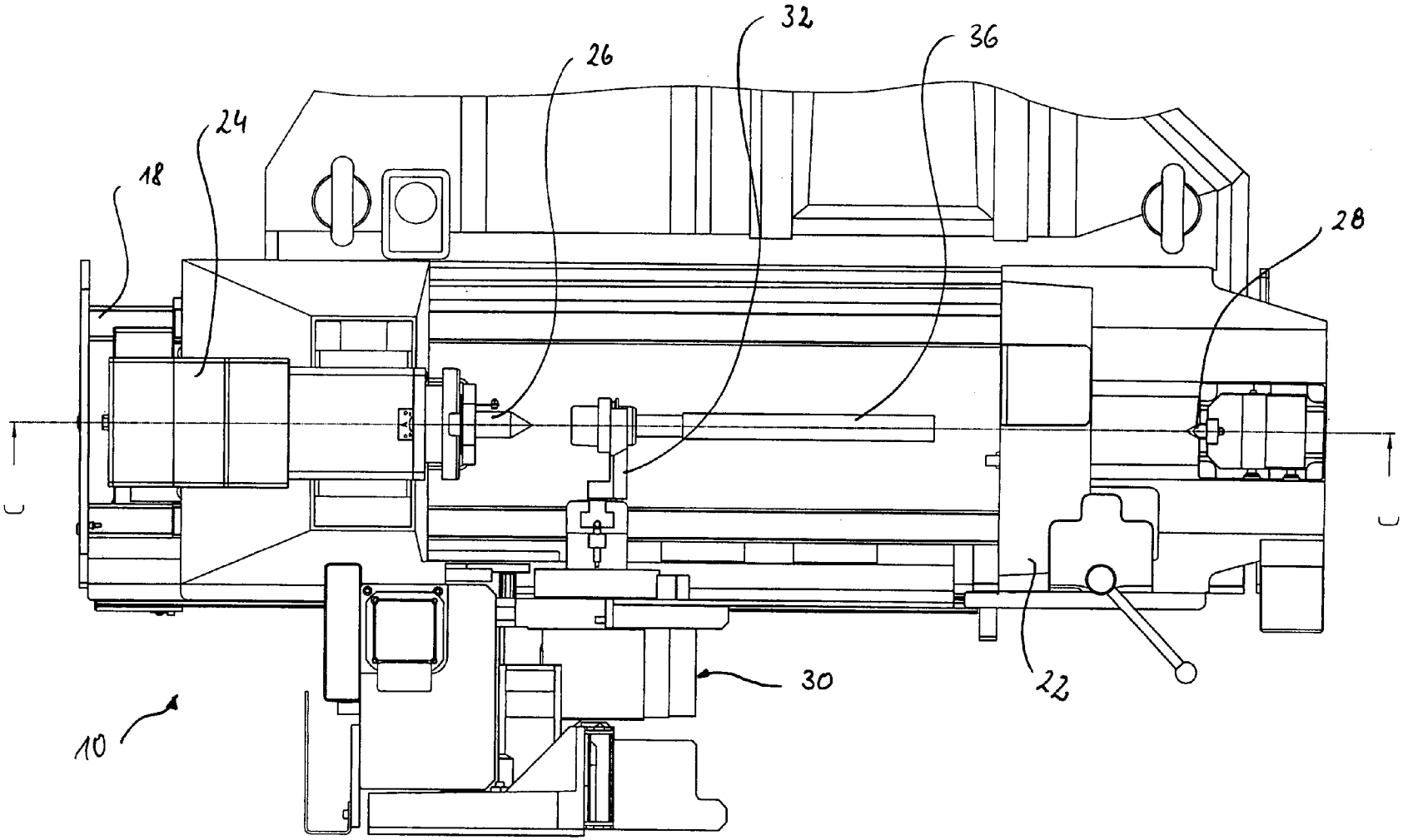
FIG. 4 shows a plan view of the arrangement corresponding to FIG. 2.
Figure 5:
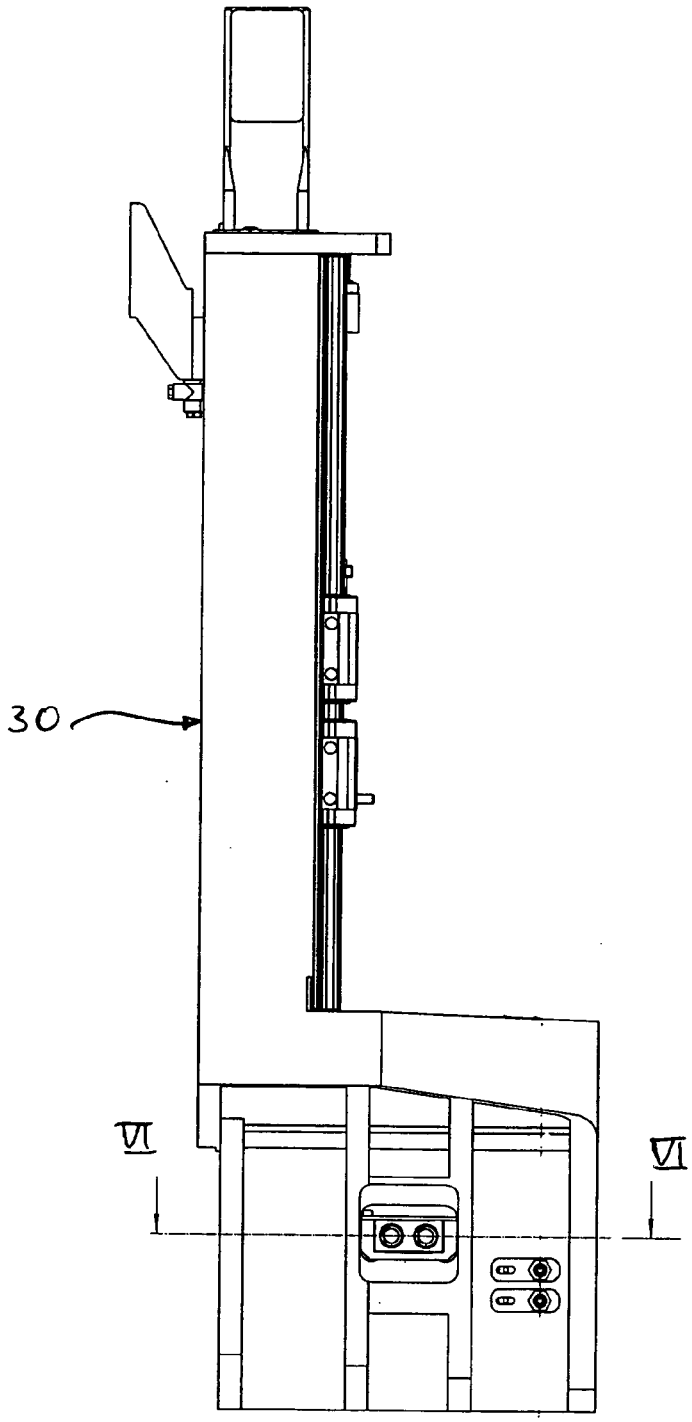
FIG. 5 shows a detail view of the positioning carriage.

To clamp the workpiece 36 between the clamping centre 26 and the tail centre 28, the apparatus 10 according to the invention is used as follows. Firstly, the workpiece 36 is removed from the magazine 34 via the gripper 32 with the aid of the positioning carriage 30 and positioned between the two centres, namely the clamping centre 26 and the tail centre 28, as shown in FIGS. 2, 3 and 4 for example. During this, the clamping centre 26 and the tail centre 28 are at a distance from the workpiece 36 held by the positioning carriage 30. The centre axis of the workpiece 36 is, however, aligned with the clamping axis A formed by the clamping centre 26 and the tail centre 28.

In the position shown in FIGS. 2 to 4, the positioning carriage 30 is held at its position and firstly the first carriage 20 with its clamping centre 26 is displaced towards the positioning carriage 30 until finally the clamping centre 26 engages in a receptacle 80 at the left-hand end of the workpiece 36 in FIG. 3. After contact has occurred between clamping centre 26 and receptacle 80, the first carriage 20 is displaced further in the direction of the workpiece 36. As a result, the positioning carriage 30 is displaced relative to the nut 40 assigned thereto, which leads to a deflection of the slide 50 inside the positioning carriage 30. When the deflection of the slide 50 reaches a value at which a limit switch is activated, the drive device of the first carriage 20 is switched off. The first carriage 20 is then displaced back so far until there is just no longer any deflection of the slide 50. The displacement of the first carriage 20 required for this is inherently predefined by the configuration of the ramp arrangement 48 and the roller 46. The first carriage 20 is now in a predetermined position for receiving the workpiece 36. The above procedure can also be carried out with the first carriage 20 being rigidly held and complementary displacement of the positioning carriage 30.

Subsequently, the second carriage 22 is displaced towards the end of the workpiece 36 opposite the receptacle 80 until finally the tail centre 28 engages in a centre provided in the workpiece. As soon as the tail centre 28 makes contact with the workpiece 36, the second carriage 22 is displaced further in the direction of the workpiece 36, during which the slide 68 is displaced against the prestress of the prestressing springs 72 and 74. When the slide 68 reaches an intermediate position predefined by the limit switch, the second carriage 22 is situated in a defined position with respect to the first carriage 20 for clamping the workpiece 36, this predetermined position being determined in each case by the length of the workpiece 36.

In order now to be able to reach a defined clamping force, the drive which drives the second carriage 22 is displaced by a certain distance, for example by 20 mm, further relative to the second carriage 22 starting from this predetermined position, during which the prestress exerted by the springs 72 and 74 increases further. As a result, a given prestress value corresponding to the desired clamping force for machining the workpiece 36 can be achieved.

Subsequently, the positioning carriage 30 releases the workpiece 36 for a machining operation and is moved into a parking position. The workpiece 36 can now be machined. During this, both carriages 20 and 22 can—if necessary—be displaced synchronously relative to one another. When the machining of the workpiece 36 is completed, the positioning carriage 30 is moved up to the workpiece 36 again and with its gripper 32 takes hold of the workpiece 36. The second carriage 22 is then moved away from the workpiece 36, the prestress decreasing as it does so. As soon as the tail centre 28 releases the workpiece 36 and moves away therefrom, the first carriage 20 can also be moved away from the workpiece 36. Subsequently, the positioning carriage 30 can deposit the finished workpiece 36 in the magazine 34.

With the apparatus according to the invention and the above-described method according to the invention for clamping workpieces between two centres, it is possible to clamp workpieces of any length fully automatically, without running the risk of damaging the workpiece during the clamping due, for example, to excessive clamping force between the centres owing to its unknown length. The apparatus according to the invention rather adapts automatically to any length of the workpiece and always achieves a predetermined desired clamping force for each workpiece irrespective of the length of the workpiece.

Although the preferred exemplary embodiment of the invention has been described above, there are a series of possible modifications which will be explained briefly below. Thus, it is possible for example to provide a spring-prestressed slide on the first carriage 20 as well, this slide allowing-relative displacement of nut and carriage via a roller. In such an embodiment, however, it is necessary to choose a considerably greater spring hardness for prestressing the slide in the first carriage than the spring hardness for prestressing the slide in the second carriage. For it is thereby possible to prevent, after clamping when the workpiece is released by the positioning carriage, the position of the workpiece still changing owing to the spring prestress acting from both sides on account of the floating mounting so to speak.

The essential advantage of the apparatus according to the invention and of the method carried out therewith lies in the fact that workpieces of any length can be reliably and securely clamped.

The invention claimed is:

1. Apparatus (10) for clamping and positioning workpieces (36) of different length between two centres (26,28), comprising:

a base (14) with at least one linear guide (18), a first carriage (20) displaceable in a linearly guided manner on the linear guide (18) and having a clamping centre (26), a second carriage (22) displaceable in a linearly guided manner on the linear guide (18) and having a tail centre (28), and a drive means coupled to the first or/and the second carriage (20,22), it being the case that the first carriage (20) and the second carriage (22) are displaceable on the linear guide (18) relative to one another and relative to the base (14) in such a way that workpieces (36) of different length can be received between the clamping centre (26) and the tail centre (28), it furthermore being the case that the first or/and the second carriage (20,22) have a prestressing means (78) and it being the case that the clamping centre (26) or/and the tail centre are displaceable, on contact (28) with the workpiece (36) to be clamped, under spring prestress towards the workpiece (36) to be clamped.

2. Apparatus (10) according to claim 1, characterised in that the workpiece (36) to be clamped can be positioned, by a positioning carriage (30) holding it, between the clamping centre (26) and the tail centre (28).

3. Apparatus (10) according to claim 2, characterised in that the positioning carriage (30) is linearly guided on a linear guide (16).

4. Apparatus (10) according to claim 2, characterised in that the positioning carriage (30) has a further prestressing means and in that the positioning carriage (30), on contact of the workpiece (36) with the clamping centre (26) or the tail centre (28), is displaceable under spring prestress relative to the clamping centre (26) or tail centre (28) engaging on the workpiece (36).

5. Apparatus (10) according to claim 1, characterised in that the drive means comprises a threaded spindle-nut arrangement.

6. Apparatus (10) according to claim 5, characterised in that the first carriage (20) is assigned a separate drive means, the first carriage (20) being coupled to the nut displaceable on the threaded spindle.

7. Apparatus (10) according to claim 5, characterised in that the second carriage (22) is assigned a separate drive means, the second carriage (22) being coupled to the nut displaceable on the threaded spindle.

8. Apparatus (10) according to claim 5, characterised in that the positioning carriage (30) is assigned a separate drive means, the positioning carriage (30) being coupled to the nut displaceable on the threaded spindle.

9. Apparatus (10) according to claim 5, characterised in that between the nut and the respective carriage there is provided a coupling arrangement (78) which allows a relative movement between nut and respective carriage with a spring prestress building up in the process.

10. Apparatus (10) according to claim 9, characterised in that the coupling arrangement comprises a roller-ramp pairing (68,70) with a roller (69) arranged between two mutually opposite ramp surfaces (70) and rolling on these surfaces, the roller (69) being arranged on the one component of nut and carriage assigned to the latter, and the ramp surfaces (70) being arranged on the other component of nut and carriage assigned to the latter.

11. Apparatus (10) according to claim 10, characterised in that the roller (69) or the ramp surfaces (70) are displaceable under spring prestress relative to the nut or the respective carriage.

12. Apparatus (10) according to claim 11, characterised in that the roller is arranged on the nut and in that a spring-prestressed slide (50, 68) formed with the ramp surfaces is displaceably guided on the respective carriage, the slide (50, 68) being displaced, upon a relative displacement of nut and respective carriage, against the spring prestress substantially in the direction orthogonal to the direction of the relative displacement.

13. Apparatus (10) according to claim 9, characterised in that the coupling device is assigned at least one limit switch which is activated when a predetermined distance is reached upon a relative displacement between nut and respective carriage.

14. Apparatus (10) according to claim 1, characterised in that at least one of the carriages, preferably each carriage, is assigned a position sensor for determining the current position of the carriage relative to the base.

15. Apparatus (10) according to claim 1, characterised in that each carriage is assigned at least one safety limit switch, the drive means stopping when the limit position predefined by the limit switch is reached.

16. Method for clamping and positioning workpieces of different length between two centres using an apparatus (10) according to one of the preceding claims, comprising the steps of:

A) positioning the workpiece to be clamped, in a region between the centres, B) bringing the workpiece into contact with the clamping centre at a workpiece clamping point facing the clamping centre, C) displacing the second carriage to bring the workpiece into contact with the tail centre at an opposite workpiece clamping point facing the tail centre, D) driving the second carriage in the direction of the first carriage after bringing the workpiece into contact with the tail centre at the opposite clamping point, E) detecting a prestress which builds up in step D or a quantity characterising this prestress, and F) deactivating the drive means assigned to the second carriage when a predetermined clamping prestress is reached.

17. Method according to claim 16, characterised in that step A) is carried out using a positioning carriage which firmly holds the workpiece during the clamping.

18. Method according to claim 17, characterised in that at step B) the first carriage is rigidly coupled to the nut of its drive means, after bringing the workpiece into contact is further displaced, by a predetermined distance, towards the positioning carriage, during which the positioning carriage is deflected relative to the nut of its drive means under spring prestress, then the first carriage is stopped when a predetermined limit prestress or a predetermined limit deflection of the positioning carriage is reached, and in that the first carriage is moved back to reduce the prestress and the deflection of the positioning carriage.

19. Method according to claim 18, characterised in that the first carriage is moved back so far until the prestress and the deflection of the positioning carriage is almost zero or precisely zero.

20. Method according to claim 16, characterised in that in step E) firstly the reaching of a predetermined limit prestress or a predetermined limit deflection is detected, and in that when the predetermined limit prestress or limit deflection is reached, the nut of the drive means assigned to the second carriage is displaced by a predetermined clamping distance.

* * * * *